US005301748A

United States Patent [19]

Potier

[11] Patent Number: 5,301,748

[45] Date of Patent: Apr. 12, 1994

[54] HEAT EXCHANGE HAVING MORE THAN ONE SET OF TUBES, IN PARTICULAR FOR A MOTOR VEHICLE

[75] Inventor: Michel Potier, Rambouillet, France

[73] Assignee: Valeo Thermique Moteur, St. Denis, France

[21] Appl. No.: 87,663

[22] Filed: Jul. 6, 1993

[30] Foreign Application Priority Data

Jul. 8, 1992 [FR] France ..... 92 08480

[51] Int. Cl.[5] ..... F28F 9/04

[52] U.S. Cl. ..... 165/173; 165/175

[58] Field of Search ..... 165/151, 153, 173, 175

[56] References Cited

U.S. PATENT DOCUMENTS 4,369,837 1/1983 Moranne ..... 165/175

5,174,372 12/1992 Potier et al. ..... 165/173

5,219,024 6/1993 Potier ..... 165/173

FOREIGN PATENT DOCUMENTS 0429401 5/1991 European Pat. Off. .

8708104 9/1987 Fed. Rep. of Germany .

*Primary Examiner*—John Rivell

*Assistant Examiner*—L. R. Leo

*Attorney, Agent, or Firm*—Morgan & Finnegan

[57] ABSTRACT

A heat exchanger, in particular an engine cooling and/or cabin air heating radiator for a motor vehicle, has a header plate formed with holes, in which each hole receives the respective end portions of a plurality of adjacent tubes in different sets of tubes in the tube bundle of the radiator. A sealing gasket is interposed between the header plate and the tubes. The tube end portions and the corresponding holes have cross sections of conjugate shapes which define between them annular gaps of substantially constant width, these annular gaps being joined, in each hole, by an intersection region having a substantially constant width.

6 Claims, 1 Drawing Sheet

HEAT EXCHANGE HAVING MORE THAN ONE SET OF TUBES, IN PARTICULAR FOR A MOTOR VEHICLE

FIELD OF THE INVENTION

This invention relates to a heat exchanger of the type comprising a bundle of parallel tubes which are arranged in sets, with the tubes having respective end portions which are received in holes formed in a header plate of the heat exchanger.

BACKGROUND OF THE INVENTION

Such heat exchangers are used especially in motor vehicles having internal combustion engines, so as to act either as a cooling radiator for the engine, or as a heating radiator for the cabin of the vehicle. In either of these two applications, the tubes in the tube bundle constituting the plurality of sets of tubes carry a fluid, which is generally a mixture of water and anti-freeze, which passes through the tubes that form part of the engine cooling circuit, while a stream of air is directed over the tubes in the bundle. It is common practice to provide, in known heat exchangers of this type, the same number of holes in the header plate as there are tubes in the bundle, so that each tube end portion will be received individually ;n a respective individual hole in the header plate, to which it is sealingly secured.

In the specification of French patent application No. 91 03411 of the present Applicants, there is disclosed a heat exchanger of the type comprising a bundle of parallel tubes arranged in sets, together with a header plate which is formed with holes, in which each said hole receives the respective end portions of a plurality of adjacent tubes of different sets of tubes in the bundle, with a compressible sealing gasket being interposed between the edge of the hole and the end portions of the tubes.

Due to the fact that the respective end portions of a plurality of tubes are received in a single hole in the header plate, instead of each end portion being received individually in one hole in &he latter, the pitch defined between the axes of the tubes, as between one set of tubes and the other, is able to be set at a minimum value. In this way, the performance of the heat exchanger can be optimised, with minimal width of the header plate.

However, in the last mentioned type of heat exchanger of the prior art, the shape of the holes is such that, after assembly, the sealing gasket cannot be compressed uniformly over the whole periphery of the tubes which are introduced into any one of the holes in the header plate. This compression is in fact weaker in that region of the gasket which lies between two adjacent tube end portions, since this region of the gasket is thinner than elsewhere on the gasket. The result is that poor sealing can occur, which is prejudicial to proper operation of the heat exchanger.

DISCUSSION OF THE INVENTION

In consequence, one object of the invention is to overcome this last mentioned disadvantage.

A further object of the invention is to provide a heat exchanger of this type which enables uniform compression of the gasket to be obtained over the whole periphery of the tubes, and especially in that region of the gasket which lies between the two adjacent tube end portions.

According to the invention, A heat exchanger of the type comprising a bundle of parallel tubes arranged in sets, together with a header plate which is formed with holes, in which each said hole receives the respective end portions of a plurality of adjacent tubes of different sets of tubes in the bundle, with a compressible sealing gasket being interposed between the edge of the hole and the end portions of the tubes, is characterised in that the end portions of the tubes, and the hole which receives them, have cross sections of conjugate shapes which together delimit annular gaps between them, the width of each gap being substantially constant, and in that the said annular gaps in each said hole are joined to each other in an intersection region lying between two adjacent tube end portions, the width of the said intersection region being substantially constant.

Due to the fact that the above mentioned annular gaps have a substantially constant width (the same being true for the intersection region), the cross sections of the tube end portions match the cross section of the hole in which they are received. Thus, the compressible gasket can be made to a substantially constant thickness, so that it is then subjected to uniform compression. As a result, substantially perfect sealing can now be guaranteed in the region of the junction between the tubes of the bundle and the header plate of the heat exchanger according to the invention.

Preferably, the two adjacent tube end portions include substantially flat faces which extend parallel to each other, and which thus define between them the above mentioned intersection region of substantially constant width.

Each of the above mentioned substantially flat faces is preferably made by local deformation of the corresponding tube end portion.

The invention is applicable in particular to a heat exchanger in which the tubes in the bundle have a non-circular cross section, for example a flattened cross section of the oval or elliptical type, such as to reduce the energy loss in the stream of air directed over the bundle, and to optimise the thermal performance of the heat exchanger. In such a heat exchanger, the tube end portions, received in the header plate, are of cross sectional shapes which may or may not be identical to those of the bodies of the tubes. Generally, however, this cross section is also of a generally oval or elliptical shape, defining a major axis and a minor axis. In this case, in accordance with the invention, the said flat face of each tube end portion is generally arranged at one end of the major axis of the cross section of that tube end portion.

Because the two said flat faces are parallel to each other, they define between them an intersection region having a substantially constant width, which may be either equal or unequal to the width of the said annular gaps. It is however preferred that the width of the intersection region should be substantially twice that of the annular gaps.

According to another feature of the invention, the compressible gasket includes annular portions which are adapted to fit in the said annular gaps, and which have a substantially constant thickness before being compressed, together with an intersection portion which is adapted to fit in the intersection region and which has a substantially constant thickness before being compressed.

The thickness of the sealing gasket, which is substantially constant before the latter is compressed, is thus again substantially constant after the gasket has been compressed, though it is of course then smaller.

The description of a preferred embodiment of the invention which follows is given by way of example only, and with reference to the accompanying drawings.

DESCRIPTION OF A PREFERRED EMBODIMENT OF THE INVENTION

Figure 1:
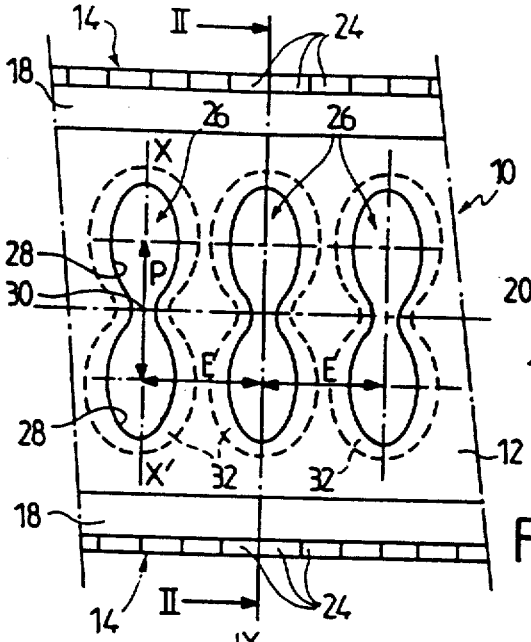
FIG. 1 is a top plan view of part of a header plate which is part of a heat exchanger in accordance with the invention.
Figure 2:
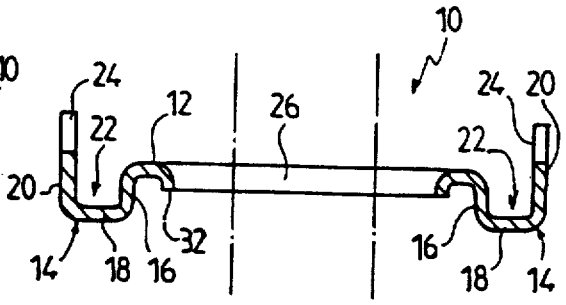
FIG. 2 is a view in cross section taken on the line 11—11 in FIG. 1.

Reference is first made to FIGS. 1 and 2, which show a header plate 10, also referred to as a perforated plate, having a spine portion 12 of generally rectangular shape. The spine portion 12 is preferably made of a metallic material, and is bounded by two parallel rims 14 corresponding to the two large sides of the rectangle, together with two other parallel rims (not shown in the drawings), which correspond to the short sides of the rectangle.

As is best seen in FIG. 2, each of the rims 14 comprises a portion 16 which is joined at a right angle to the spine portion 12, a portion 18 which is joined at a right angle to the first portion 16, and finally a portion 20 which is joined at a right angle to the second portion 18. The portions 16 and 18 of each rim 14 thus define a groove 22 which extends over the whole periphery of the header plate 10. The function of this groove 22 will be explained below. Each of the rim portions 20 is crenellated on its free edge, so as to define a series of lugs 24 which are capable of being bent over during the assembly of the header plate with an associated header wall (not shown).

A set of oblong holes 26, identical to each other, is formed through the spine portion 12 of the header plate 10. Three of these holes 26 can be seen in FIG. 1.

Each hole 26 has an axis of symmetry XX' extending along its length and at right angles to the rims 14 of the header plate 10. Each hole 26 is defined by two substantially identical oval sections which intersect in a neck 30. In this example, the two sections 28 of each hole 26 are generally elliptical, with their respective major axes being aligned in the direction of the axis XX'. The respective centres of the two elliptical sections 28 define between them a transverse pitch P. In addition, the distance between two adjacent holes 26 is defined by a longitudinal pitch E 10 in the direction at right angles to the transverse pitch p.

Each of the holes 26 is surrounded by a collar portion 32, the contour of which corresponds to that of the two sections 28 of the hole, including the neck 30. Each collar portion 32 projects from the spine portion 12 on the side opposite to the lugs 24. As will be seen later in this description, each hole 26 is arranged to receive the respective end portions of two tubes which are part of two adjacent sets of tubes in a bundle consisting of two sets of tubes of the heat exchanger. Within either one of these sets, the tubes are separated from each other by a pitch equal to the longitudinal pitch E (FIG. 1).

Figure 3:
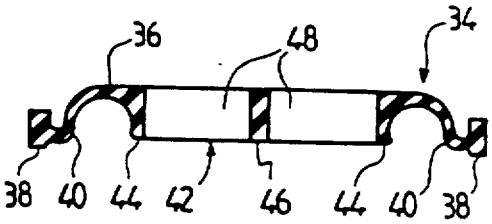
FIG. 3 is a view in cross section of a sealing gasket for the header plate of FIGS. 1 and 2.

Reference is now made to FIG. 3, which shows a sealing gasket 34 which is adapted to be applied on the header plate 10. The gasket 34 is made in a compressible elastomeric material, and has a spine portion 36 of generally rectangular shape corresponding to that of the spine portion 12 of the header plate 10. The spine portion 36 of the gasket is bounded by two longitudinal beads 38 which correspond to the two long sides of the rectangle, together with two lateral beads (not shown) which correspond to the two short sides of the rectangle. The beads 38 are joined to the spine portion 36 of the gasket through an integral web 40. In this way, a bead is obtained which extends over the whole periphery of the gasket, and which is suitable for introduction into the groove 22 of the header plate.

The gasket spine portion 36 includes compressible collar portions 42, each of which has a shape which is adapted to that of a corresponding one of the holes 26 in the header plate, so that it can be introduced into the latter when the spine portion 36 cf the gasket 34 is applied against the spine portion 12 of the header plate 10. Thus each collar portion 42 of the gasket has the general shape of a figure-of-eight, comprising two oval, annular portions 44 joined together through an integral bridge 46. Thus, when a compressible collar portion 42 is introduced into a corresponding collar portion 32 of the header plate 10, the two annular portions 44 of the collar portion 42 engage respectively in the two corresponding sections 28 of the hole 26, with the integral bridge 42 being located in the neck 30 of the latter. The gasket spine portion 36 defines two orifices within each compressible collar portion 42. Each of these orifices is adapted to receive the end portion of the corresponding tube of the bundle.

Figure 4:
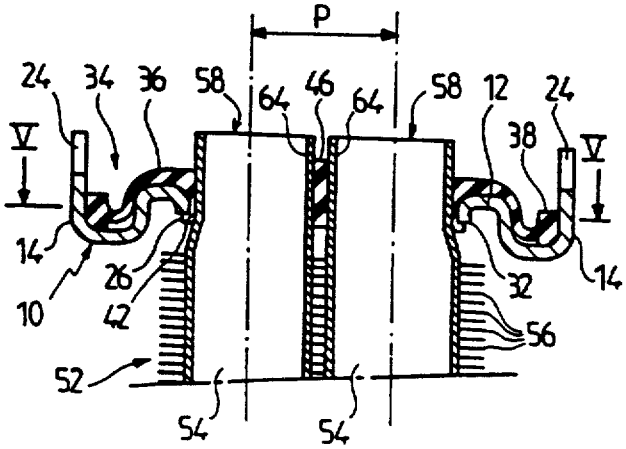
FIG. 4 is a view in transverse cross section through part of a heat exchanger comprising a bundle of tubes assembled on the header plate of FIGS. 1 and 2, with the sealing gasket of FIG. 3 interposed.

FIG. 4 shows one pair of these tubes, associated with one of the holes 26 in the header plate. In FIG. 4, the tube bundle, indicated generally at 52, comprises two sets of tubes 54 of non-circular cross section, which extend through a multiplicity of parallel fins 56. The tubes 54 are separated from each other, as mentioned above, by a longitudinal pitch distance E within the same set of tubes, and by a transverse pitch distance P as between one set of tubes and the other. The tubes 54 have respective end portions 58 of noncircular cross section, which are spaced apart by the same longitudinal pitch E and transverse pitch P as the tubes.

Figure 5:
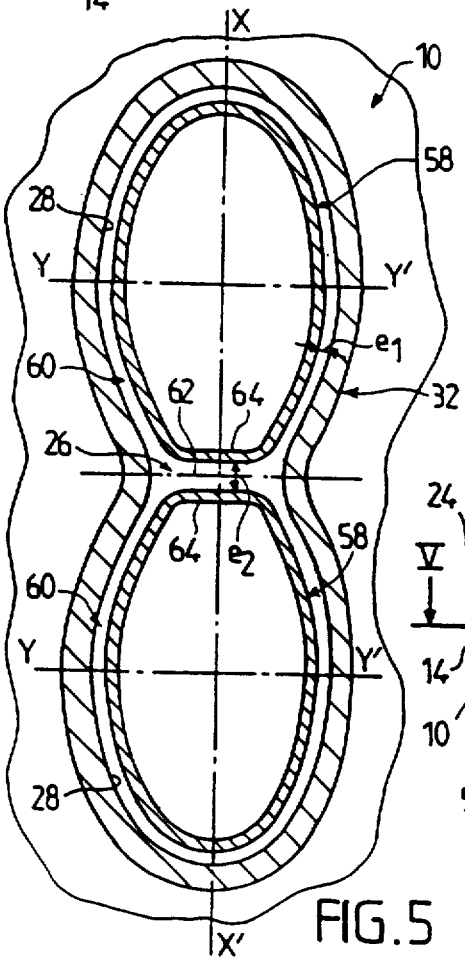
FIG. 5 is a view in cross section on a larger scale, taken on the line V—V in FIG. 4, with the sealing gasket being omitted in the interests of simplification.

A heat exchanger comprising a header plate, gasket, tubes and fins as described up to this point is of the kind disclosed in the above mentioned French patent specification. However, in the heat exchanger shown in the drawings, the end portions 58 of the tubes 54, and each hole 26 which receives them, have cross sections of conjugated shape, which delimit between them annular gaps 60 having a gap width e1 which is substantially constant over the whole periphery of the end portions 58 which are surrounded by these gaps (see FIG. 5). These annular gaps 60 are joined together by an intersection region 62 which lies between the two end portions 58 received in the hole 26.

The intersection region 62 has a width e2 which is substantially constant, and which is preferably substantially equal to twice the gap width e1. In order to provide this substantially constant width of the intersection region, the two adjacent end portions 58 of the tubes include substantially flat faces 64, which extend parallel to each other and parallel to the minor axes YY' of the elliptical cross sections of the end portions 58. The intersection zone 62 is thus delimited by the two faces 64, in facing relationship with each other, and by the two edges of the neck 30.

Each of the substantially flat faces 64 is obtained by local deformation of the corresponding end portion 58 of the appropriate tube. In this example, in which the end portion 58 has a cross section of generally oval or elliptical shape, with a major axis and a minor axis, the flat face 64 is arranged at one end of the major axis. Such a flat face could of course alternatively be formed on tubes having end portions of different cross sectional shape. Again, in the case of a heat exchanger having more than two sets of tubes, some tube end portion cross sections will have a single flat 10 face, with others having two opposed flat faces.

The annular portions 44 of the compressible gasket 34 have, before being compressed, a thickness which is substantially constant and which is greater than the dimension e1. After being compressed, the thickness of the annular portions 44 is again constant, but is equal to e1. The annular portions 44 are joined together through the integral bridge 46 which constitutes an intersection portion and which, before being compressed, has a thickness which is substantially constant and greater than the width e2 of the intersection region 62. After being compressed, the thickness of the integral bridge 46 is equal to e2. As a result, the whole of the gasket 34 has then undergone uniform compression, both in its annular portions 44 and in its intersection portion 46.

In this way, homogeneous compression cf the gasket over the whole periphery of the tubes is obtained. As has been indicated above, the invention is applicable to heat exchangers having tubes with end portions of different cross sectional shapes. The invention is also applicable to heat exchangers having more than two sets of tubes.

What is claimed is:

1. A heat exchanger comprising: a plurality of sets of parallel tubes constituting a tube bundle, with each tube having an end portion; .a header plate formed with a plurality of holes each having an edge, With the said end portion of each of a plurality of adjacent said tubes of different sets being received in each said hole and a compressible sealing gasket interposed between the edge of each said hole and associated tube end portions, wherein each said hole and the associated tube end portions define conjugate cross sectional shapes which themselves together define annular gaps of substantially constant width within the hole, and an intersection region of the hole joining the respective associated annular gaps and lying between two adjacent tube end portions, such that the width of the said intersection region is substantially constant.

2. A heat exchanger according to claim 1, wherein each of two adjacent said tube end portions defines a substantially flat face, with said faces of the adjacent end portions being parallel to each other.

3. A heat exchanger according to claim 2, wherein each substantially flat face is formed by local deformation of the corresponding tube end portion.

4. A heat exchanger according to claim 2, wherein each tube end portion defines a generally oval cross sectional shape having a major axis and a minor axis, with the substantially flat face of the tube end portion being located at one end of the major axis.

5. A heat exchanger according to claim 1, wherein the width of said intersection region is substantially twice that of each of said annular gaps.

6. A heat exchanger according to claim 1, wherein the sealing gasket has annular portions for fitting in the said annular gaps and an intersection portion for fitting in the said intersection region, with each said annular portion and intersection portion having a respective substantially constant uncompressed thickness.

* * * * *